US011509098B2

(12) United States Patent
Huang et al.

(10) Patent No.: US 11,509,098 B2
(45) Date of Patent: Nov. 22, 2022

(54) ELECTRICAL CONNECTING ASSEMBLY

(71) Applicant: Dongguan Luxshare Technologies Co., Ltd, Dongguan (CN)

(72) Inventors: Bin Huang, Dongguan (CN); RongZhe Guo, Dongguan (CN); HongJi Chen, Dongguan (CN); HuanHuan Shen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 60 days.

(21) Appl. No.: 17/239,996

(22) Filed: Apr. 26, 2021

(65) Prior Publication Data

US 2022/0037836 A1 Feb. 3, 2022

(30) Foreign Application Priority Data

Aug. 3, 2020 (CN) ..... 202010766830.0

(51) Int. Cl.
*H01R 4/66* (2006.01)
*H01R 13/6471* (2011.01)
(Continued)

(52) U.S. Cl.
CPC ..... *H01R 13/6471* (2013.01); *H01R 12/716* (2013.01); *H01R 13/502* (2013.01); *H01R 13/6587* (2013.01); *H01R 13/6594* (2013.01)

(58) Field of Classification Search
CPC .. H01R 12/712; H01R 12/716; H01R 13/502; H01R 13/6471; H01R 13/6587; H01R 13/6594
(Continued)

(56) References Cited

U.S. PATENT DOCUMENTS 5,967,831 A * 10/1999 Yamada ..... H01R 12/79 439/496
6,027,375 A * 2/2000 Wu ..... H01R 13/502 439/607.02
(Continued)

FOREIGN PATENT DOCUMENTS

CN 203367647 U 12/2013
CN 104979717 A 10/2015
(Continued)

*Primary Examiner* — Khiem M Nguyen

(74) *Attorney, Agent, or Firm* — Birch, Stewart, Kolasch & Birch, LLP

(57) ABSTRACT

The present disclosure provides an electrical connecting assembly, comprising an electrical connector and a circuit board. The electrical connector comprises a plurality pairs of signal terminals and a plurality of ground terminals. One ground terminal is disposed between two pairs of adjacent signal terminals. Each of the signal terminals comprises a bent part and a signal terminal plugging part. Each of the ground terminals comprises a shielding part and a ground terminal plugging part. The circuit board comprises a plurality pairs of signal terminal plugging holes and a plurality of signal ground terminal plugging holes. The plurality of ground terminal plugging holes are arranged along a baseline. Each pair of the signal terminal plugging holes are respectively disposed on two sides of the baseline. The bent parts of the plurality of the signal terminals alternately extend toward two sides of the baseline.

10 Claims, 8 Drawing Sheets

(51) Int. Cl.

| | |
|---|---|
| ***H01R 12/71*** | (2011.01) |
| ***H01R 13/502*** | (2006.01) |
| ***H01R 13/6587*** | (2011.01) |
| ***H01R 13/6594*** | (2011.01) |

(58) Field of Classification Search
USPC ..... 439/92, 108
See application file for complete search history.

(56) References Cited

U.S. PATENT DOCUMENTS

| | | | | |
|---|---|---|---|---|
| 7,048,585 | B2 * | 5/2006 | Milbrand, Jr ..... | H01R 13/6585<br>439/607.09 |
| 2022/0037836 | A1 * | 2/2022 | Huang ..... | H01R 13/6585 |

FOREIGN PATENT DOCUMENTS

| | | | |
|---|---|---|---|
| TW | 200922017 | A | 5/2009 |
| TW | 201310795 | A1 | 3/2013 |
| TW | 201803229 | A | 1/2018 |

* cited by examiner

ELECTRICAL CONNECTING ASSEMBLY

CROSS-REFERENCE TO RELATED APPLICATION

This application claims the priority benefit of Chinese Patent Application Serial Number 202010766830.0, filed on Aug. 3, 2020, the full disclosure of which is incorporated herein by reference.

BACKGROUND

Technical Field

The present disclosure relates to the technical field of signal shielding, particularly to an electrical connecting assembly, which performs signal shielding and connects an electrical connector to a circuit board.

Related Art

Considering the terminal stacking structure of conventional external input/output electrical connector such as SFP, QSFP, OSFP, or OSFP-DD, the signal terminal pair and the ground terminal are inserted into the plugging holes of the circuit board in an alternate arrangement, i.e., a ground terminal is disposed between two adjacent signal terminal pairs, so that the ground terminal can perform electromagnetic shielding. However, for avoiding the plugging holes of other components on the circuit board, most of the signal terminal plugging holes on the conventional circuit board are configured in a left-and-right alternate arrangement, so that the signal terminal would extend to the plugging holes on the left and right sides relative to the ground terminal when it is inserted into the circuit board. However, there would be crosstalking between signal terminals having the configuration described above when transmitting high-frequency signals.

The prior art can be referred to FIG. 1, a perspective view of a conventional electrical connecting assembly, FIG. 2, a side view of the electrical connecting assembly of FIG. 1, and FIG. 3, a cross-sectional view of the electrical connecting assembly of FIG. 2 along line A-A'. As shown in the figures, in the prior art, two symmetrical metal shielding members S are soldered onto two ground terminals G respectively, and surround the signal terminal pair I1 and I2 with the ground terminal G to deal with the problem of crosstalking as being electromagnetic shielders. However, in the prior art, as the metal shielding members S would be considerably occupying the circuit board, and according to the simulation results, the integrated crosstalk noise (ICN) value of the prior art is between 4.2 and 4.8, which has exceeded the standard value of 3.6 of the OIF (Optical Internetworking Forum) regulation. Thus, it can be seen that the prior art does not comply with the regulation.

SUMMARY

The embodiments of the present disclosure provide an electrical connecting assembly to solve the problem of noise crosstalking generated by the signal terminals of a conventional electrical connecting assembly extending to two sides of the terminal arranging baseline.

An electrical connecting assembly is provided, which comprises an electrical connector and a circuit board. The electrical connector comprises a plurality pairs of signal terminals and a plurality of ground terminals. One ground terminal is disposed between two pairs of adjacent signal terminals. Each of the signal terminals comprises a bent part and a signal terminal plugging part. The bent part is adjacent to the signal terminal plugging part. Each of the ground terminals comprises a shielding part and a ground terminal plugging part. The shielding part is adjacent to the ground terminal plugging part. The shielding part corresponds to the bent part. The circuit board comprises a plurality pairs of signal terminal plugging holes and a plurality of signal ground terminal plugging holes. The plurality of ground terminal plugging holes are arranged along a baseline. One ground terminal plugging hole is disposed between two pairs of signal terminal plugging holes. Each pair of the signal terminal plugging holes are respectively disposed on two sides of the baseline. The bent parts of the plurality of the signal terminals alternately extend toward two sides of the baseline. The signal terminal plugging parts are respectively inserted into the signal terminal plugging holes and are electrically connected to the circuit board. The ground terminal plugging part of each of the ground terminals is correspondingly inserted into the ground terminal plugging hole and is electrically connected to the circuit board. The width of the shielding part in a direction orthogonal to the baseline is greater than or equal to the length of the bent part of each of the signal terminals extending toward two sides of the baseline.

In the embodiments of the present disclosure, by providing a shielding part at the part of the ground terminal close to the circuit board, and by allowing the width of the shielding part in the direction orthogonal to the baseline to be greater than or equal to the length of the bent part of the signal terminal, the shielding part can at least shield the bent part of the signal terminal to solve the problem of crosstalking noise between signal terminal pairs. Since the ground terminal is provided with a wide shielding part only in the direction orthogonal to the baseline to electromagnetically shield, it would not additionally occupy the circuit board and would not affect the configuration of other electronic components on the circuit board.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
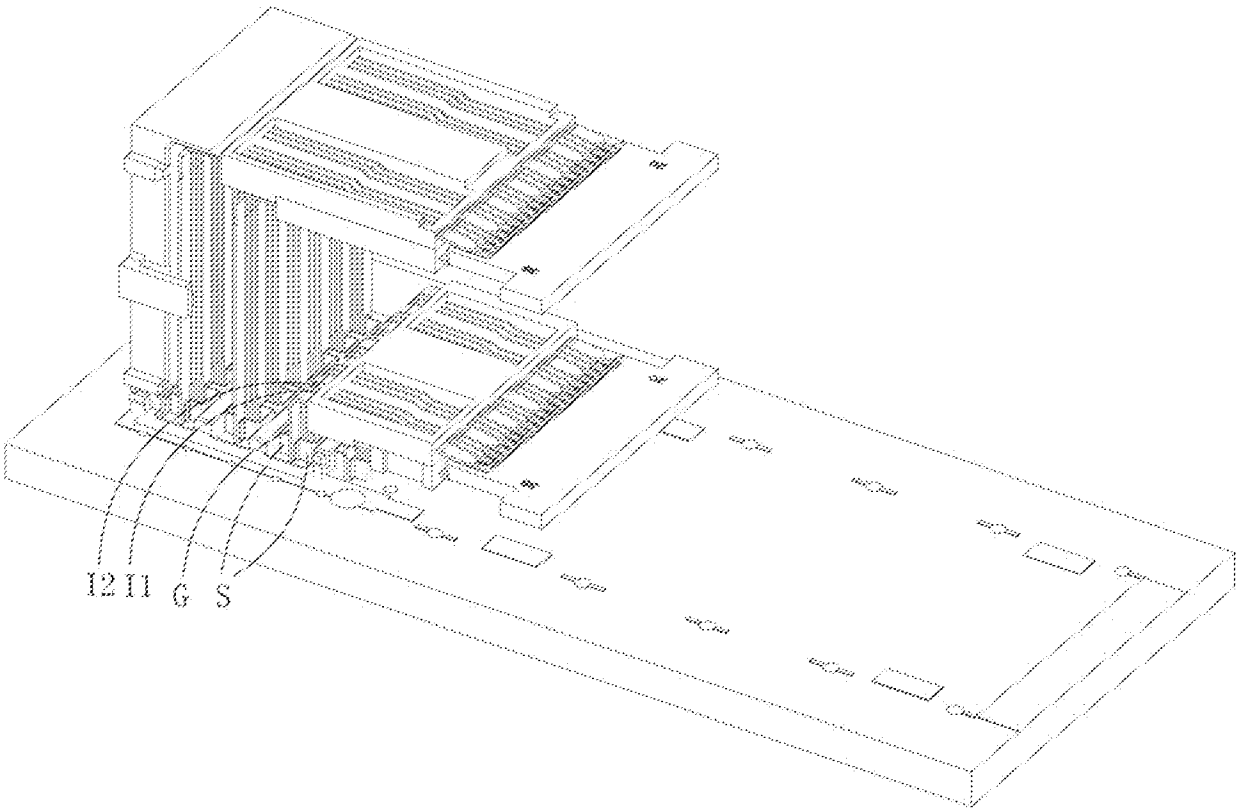
FIG. 1 (Prior Art)
FIG. 1 is a perspective view of a conventional electrical connecting assembly.
Figure 2:
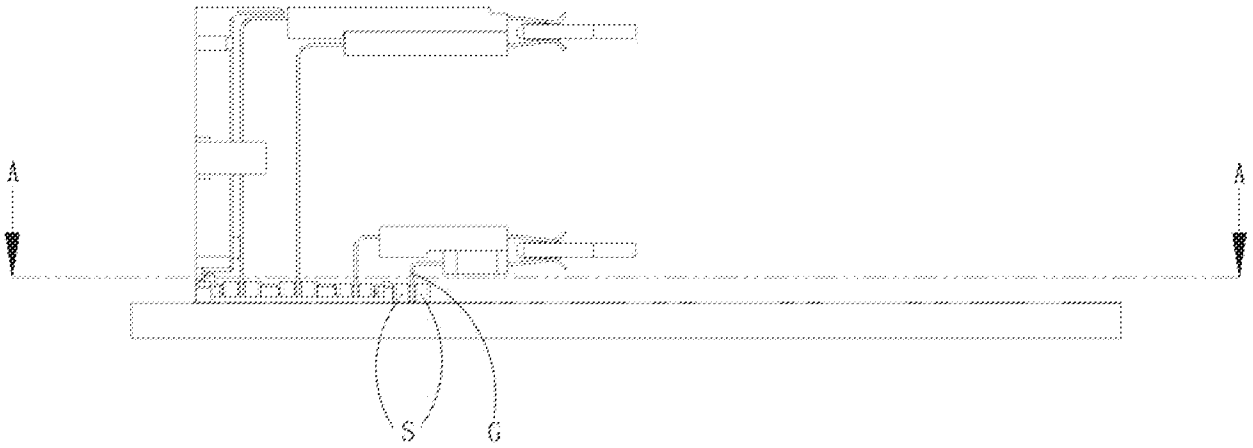
FIG. 2 (Prior Art)
FIG. 2 is a side view of the electrical connecting assembly of FIG. 1.
Figure 3:
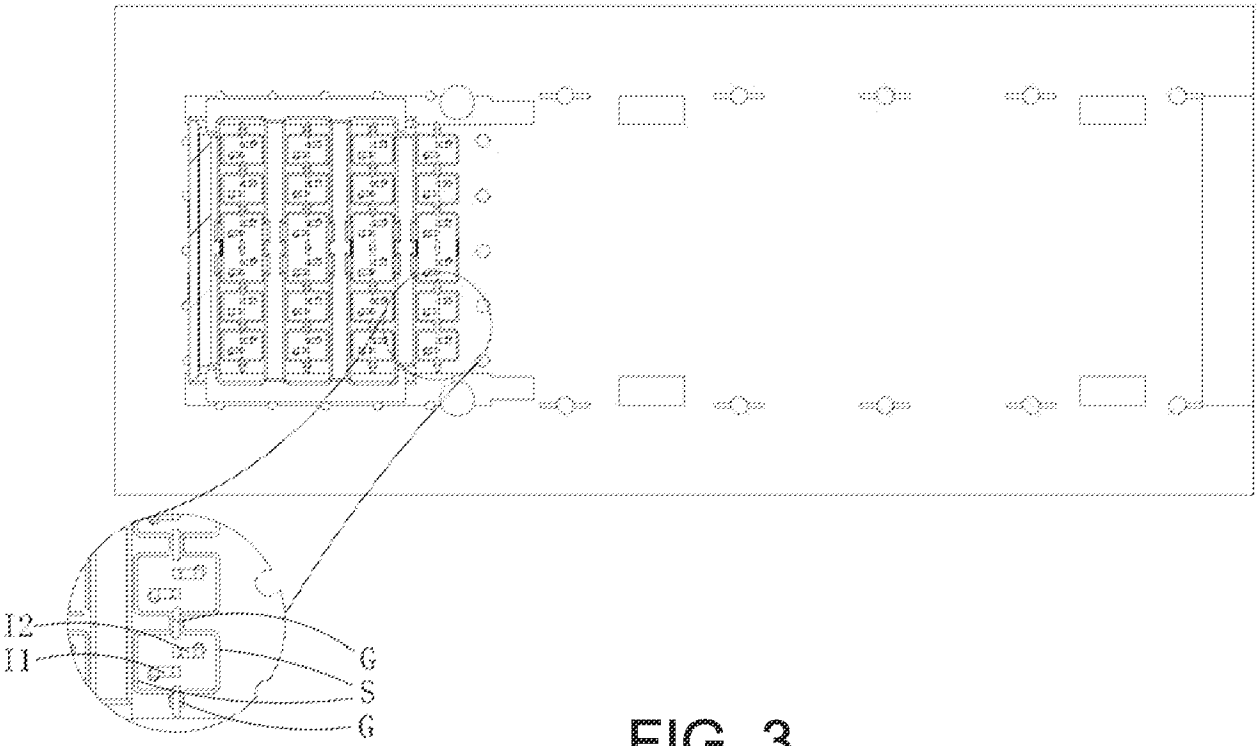
FIG. 3 (Prior Art)
FIG. 3 is a cross-sectional view of the electrical connecting assembly of FIG. 2 along line A-A'.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to member a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Regarding the "first", "second", etc. used in this article, it does not specifically refer to the order or sequence, nor is it intended to limit the application, but only to distinguish between components or operations described in the same technical terms.

Figure 4:
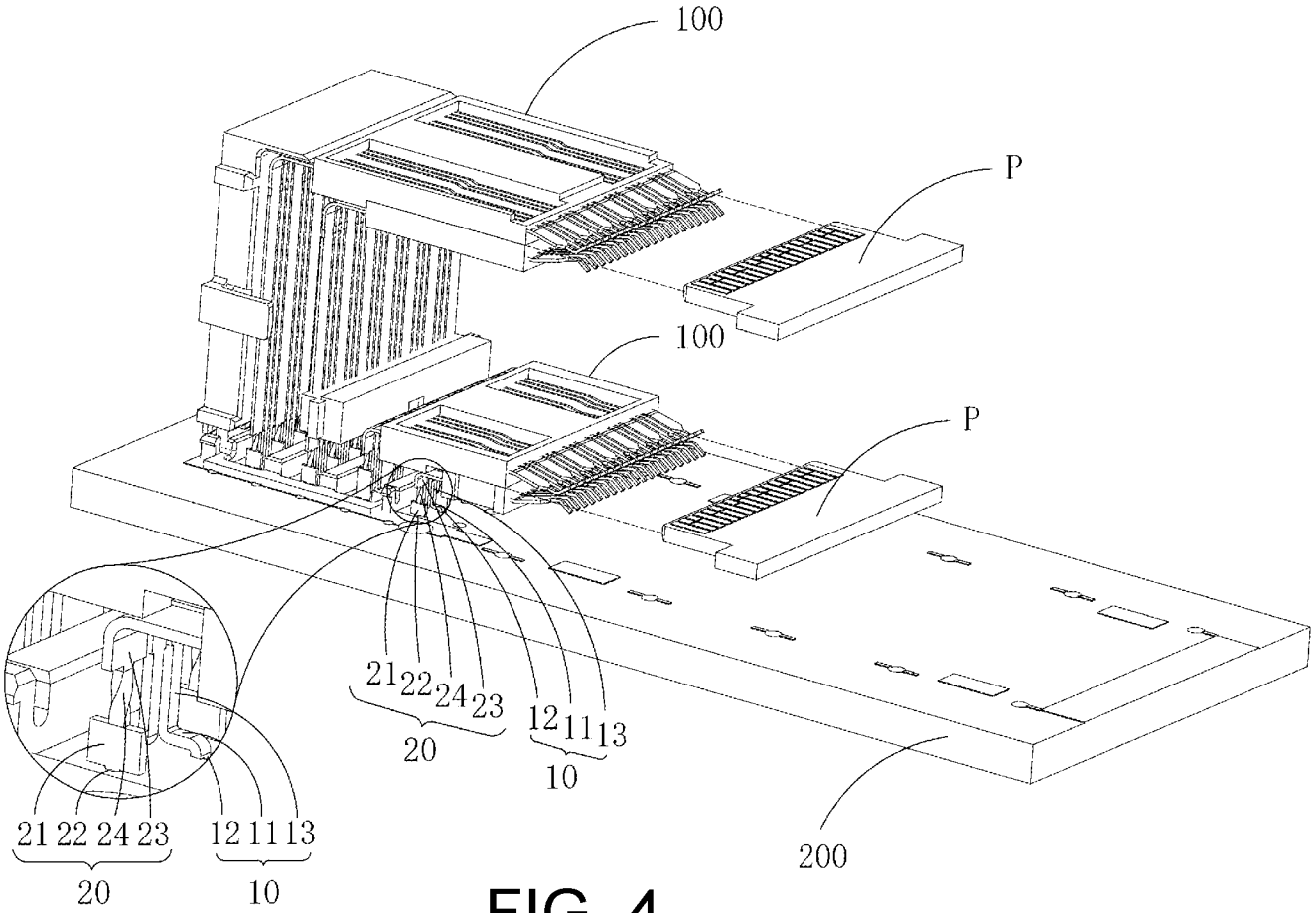
FIG. 4 is a perspective view of an electrical connecting assembly of an embodiment of the present disclosure.
Figure 5:
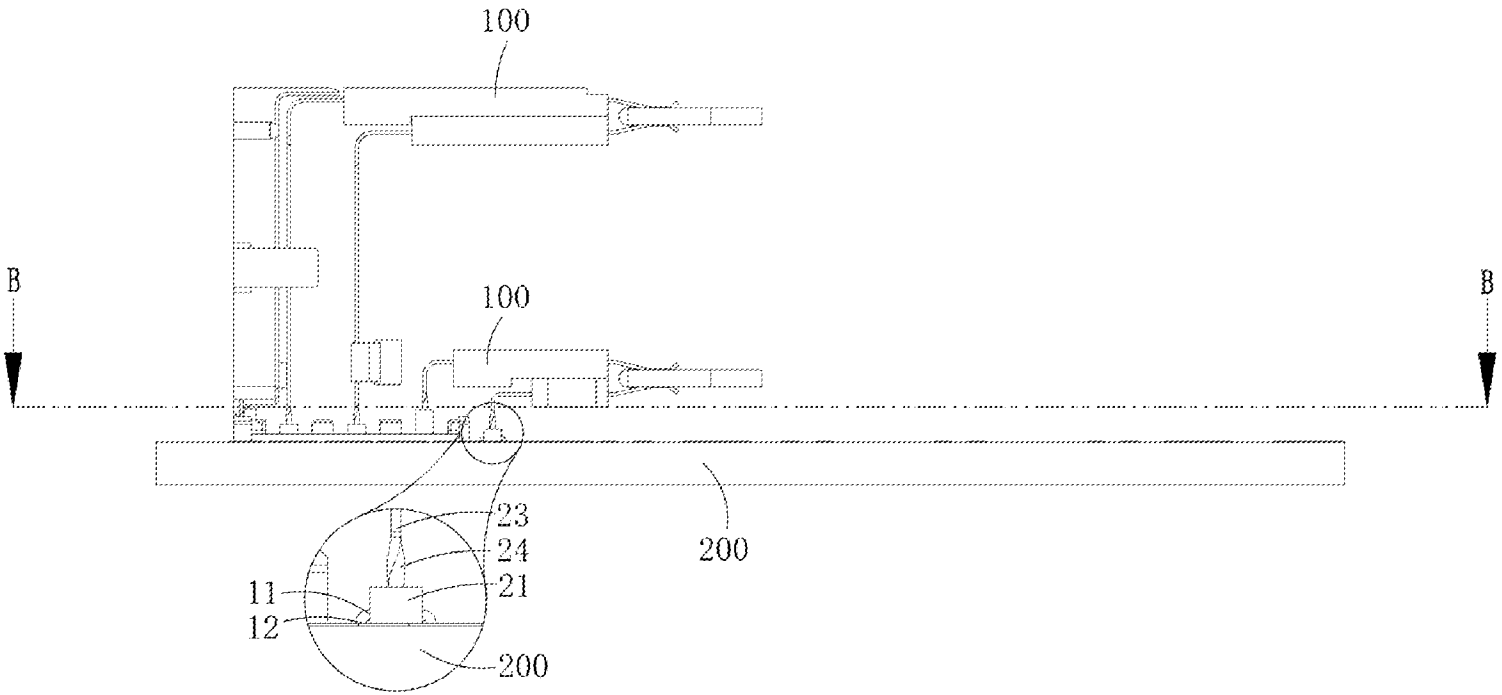
FIG. 5 is a side view of the electrical connecting assembly of FIG. 4.
Figure 6:
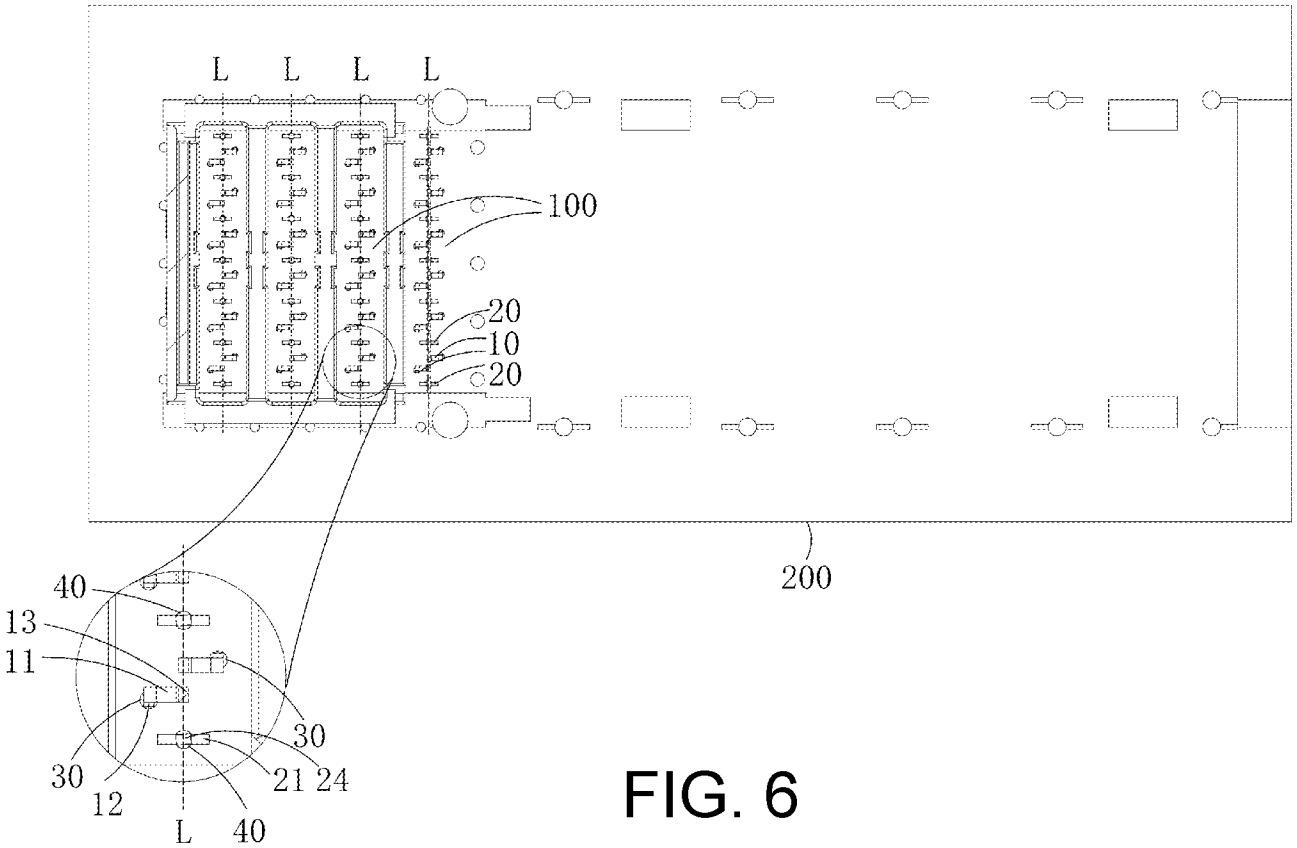
FIG. 6 is a cross-sectional view along line B-B' of FIG. 5.

Referring to FIGS. 4 to 6, which are a perspective view of an electrical connecting assembly of an embodiment of the present disclosure, a side view of the electrical connecting assembly of FIG. 4, and a cross-sectional view along line B-B' of FIG. 5. As shown in the figures, this embodiment provides an electrical connecting assembly, which comprises an electrical connector 100 and a circuit board 200. The electrical connector 100 is inserted into the circuit board 200 and is electrically connected to the circuit board 200. In this embodiment, two electrical connectors 100 are disposed on the circuit board 200. Since the two electrical connectors 100 are only different in height with the same configuration of the terminal, only one of the electrical connectors 100 would be taken as an example for further description.

As shown in FIG. 4 and FIG. 6, the electrical connector 100 comprises a plurality pairs of signal terminals 10 and a plurality of ground terminals 20. The plurality pairs of signal terminals 10 and the plurality of ground terminals 20 of the electrical connector 100 are arranged in two rows of terminals. Each of the terminal rows comprises the plurality pairs of signal terminals 10 and the plurality of ground terminals 20, and one ground terminal 20 is provided between two pairs of adjacent signal terminals 10.

As shown in FIG. 4 and FIG. 6, each of the signal terminals 10 comprises a bent part 11 and a signal terminal plugging part 12. The bent part 11 is adjacent to the signal terminal plugging part 12. Each of the ground terminals 20 comprises a shielding part 21 and a ground terminal plugging part 22. The shielding part 21 is adjacent to the ground terminal plugging part 22 and corresponds to the bent part 11. Besides, each of the signal terminals 10 further comprises a signal terminal body 13. The bent part 11 is adjacent to the signal terminal body 13 and the signal terminal plugging part 12 and is disposed between the terminal body 13 and the signal terminal plugging part 12. Each of the ground terminals 20 further comprises a ground terminal body 23. The shielding part 21 is adjacent to the ground terminal body 23 and the ground terminal plugging part 22 and is disposed between the terminal body 23 and the ground terminal plugging part 22. The signal terminal body 13 and the ground terminal body 23 extend in a direction perpendicular to the circuit board 200. The signal terminal bodies 13 of the plurality of signal terminals 10 and the ground terminal bodies 23 of the plurality of ground terminals 20 are perpendicular to the circuit board 200 and are arranged in a row along the baseline L on the circuit board 200. After being bent in the insulating housing (not shown in FIG. 4) of the electrical connector 100, the signal terminal body 13 of the signal terminal 10 and the ground terminal body 23 of the ground terminal 20 of the two terminal rows extend parallel to the circuit board 200 and form two rows of terminal rows (up and low) at the plugging slot of the insulating housing. The signal terminal body 13 of the signal terminal 10 and the ground terminal body 23 of the ground terminal 20 of the two terminal rows could form an arc-shaped elastic component in the plugging slot, which can clamp the circuit board P inserted in the plugging slot of the electrical connector 100.

Each of the signal terminal pairs comprises two signal terminals 10. After being bent, the bent parts 11 of the two signal terminals 10 of each of the signal terminal pairs respectively extend from the signal terminal body 13 toward two sides of the baseline L in a manner parallel to the circuit board 200. In the two adjacent pairs of signal terminals 10 on two sides of the ground terminal 20, the extending directions of the bent parts 11 of the signal terminals 10 on two sides of the ground terminal 20 are different in the direction along the baseline L.

As shown in FIG. 4 and FIG. 6, the circuit board 200 comprises a plurality pairs of signal terminal plugging holes 30 and a plurality of ground terminal plugging holes 40. The plurality pairs of signal terminal plugging holes 30 and the plurality of ground terminal plugging holes 40 are arranged in two rows on the circuit board 200 along two parallel baselines L, wherein the ground terminal plugging holes 40 are arranged along the baseline L. One ground terminal plugging hole 40 is provided between the two pairs of signal terminal plugging holes 30, and each pair of signal terminal plugging holes 30 are respectively disposed on two sides of the baseline L.

Thus, the bent parts 11 of the plurality of signal terminals 10 extend alternately toward two sides of the baseline L, and the signal terminal plugging parts 12 are respectively inserted into the signal terminal plugging holes 30 and are electrically connected to the circuit board 200. The ground terminal plugging part 22 of each of the ground terminals 20 is correspondingly inserted into the ground terminal plugging hole 40 and is electrically connected to the circuit board 200. The signal terminal plugging part 12 of the signal terminal 10 and the ground terminal plugging part 22 of the ground terminal 20 comprise an elastic press-fitting component, which can be a fisheye press-fitting component comprising arc-shaped bumps on its two sides and holes disposed between the two arc-shaped bumps. The arc-shaped bump abuts against the hole walls of the signal terminal plugging hole 30 and the ground terminal plugging hole 40. Through the restoring force generated by pushing the arc-shaped bump to deform by the signal terminal plugging hole 30 and the ground terminal plugging hole 40, a holding force of the signal terminal 10 and the ground terminal 20 respectively positioned in the signal terminal plugging hole 30 and the ground terminal plugging hole 40 can be formed. In the configuration described above, the baseline L passes through the midpoint of the shielding part 21, and the bent part 11 of each of the signal terminals 10 is closer than the signal terminal body 13 to the circuit board 200. Furthermore, the bent part 11 is configured to be as close as possible to the circuit board 200. The shielding part 21 of each of the ground terminals 20 is closer than the ground terminal body 23 to the circuit board 200, and the shielding part 21 of the ground terminal 20 is also configured to be as close as possible to the circuit board 200.

Figure 7:
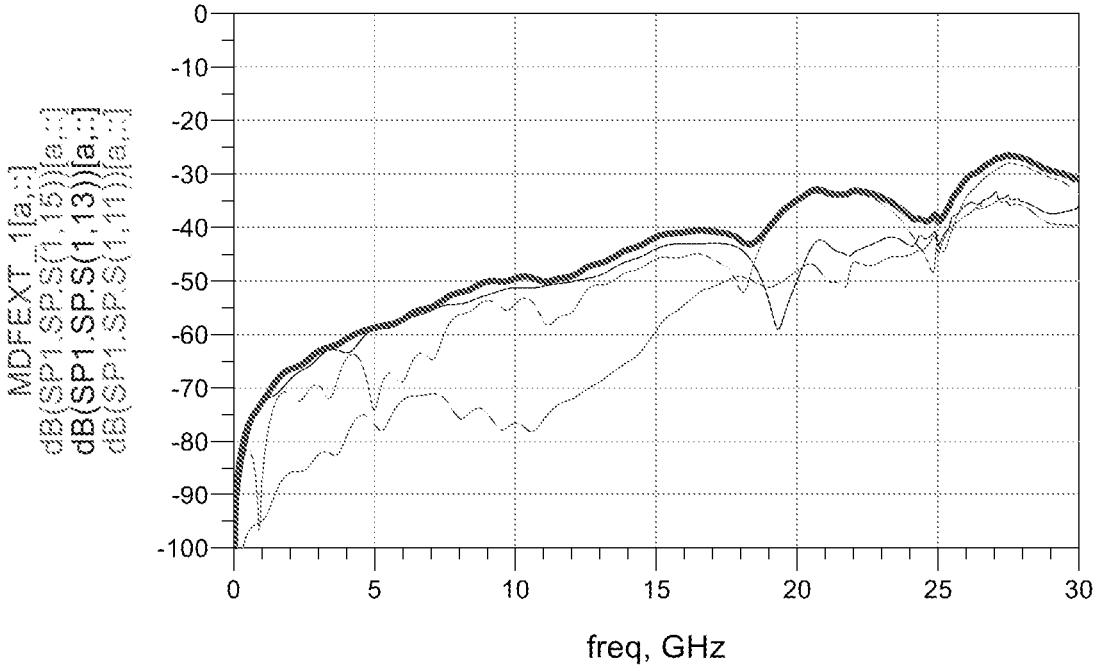
FIG. 7 and FIG. 8 are curve diagrams of MDFEXT of an electrical connecting assembly versus signal frequency of an embodiment of the present disclosure.
Figure 8:
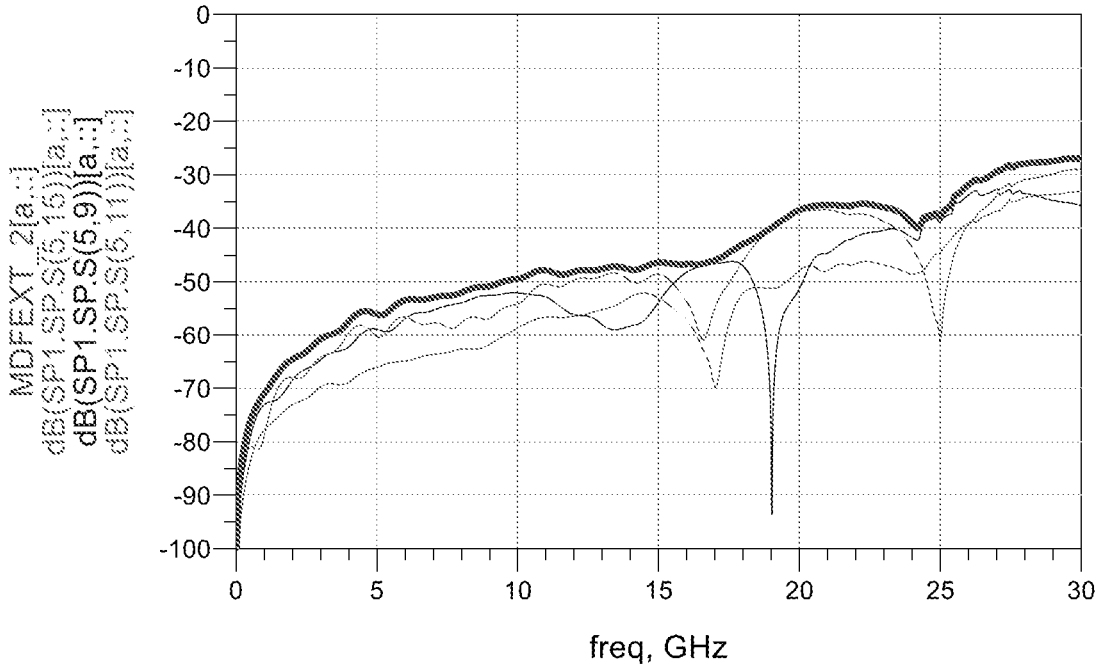

The width of the shielding part 21 in the direction orthogonal to the baseline L is configured to be greater than or equal to the length of the bent part 11 of each of the signal terminals 10 extending toward two sides of the baseline to allow the electromagnetic shielding function to solve the problem of crosstalking noise between signal terminal pairs. As shown in FIG. 7 and FIG. 8, after the simulation of the electrical connecting assembly of the present disclosure, the integrated crosstalk noise (ICN) is reduced to be within the range between 1.5 and 1.9, which is way smaller than the value of 3.6 of the OIF regulation. Thus, the electrical connecting assembly of the present disclosure complies with the regulation.

As shown in FIG. 4, in this embodiment, the width of the ground terminal body 23 in the extending direction of the baseline L is wider than the width of the signal terminal body 13 in the extending direction of the baseline L and the width of the shielding part 21 of the ground terminal 20 in the direction orthogonal to the baseline L is equal to the width of the ground terminal body 23 of the ground terminal 20 in the extending direction of the baseline L. That is, the width of the shielding part 21 for shielding the signal terminal 10 is equal to the width of the ground terminal body 23. The ground terminal 20 further comprises a connecting part 24, which is connected with the ground terminal body 23 and the shielding part 21. Two ends of the connecting part 24 are respectively connected to the midpoint of one end of the ground terminal body 23 and the midpoint of one end of the shielding part 21, and the connecting part 24 has a twisted-shape. That is, during the manufacturing process of the ground terminal 20, the shielding part 21 and the ground terminal body 23 can be formed of the same metal strip, and the connecting part 24 connecting the shielding part 21 and the ground terminal body 23 can be twisted 90 degrees to form a component in which the width direction of the shielding part 21 is orthogonal to the width direction of the ground terminal body 23.

Figure 9:
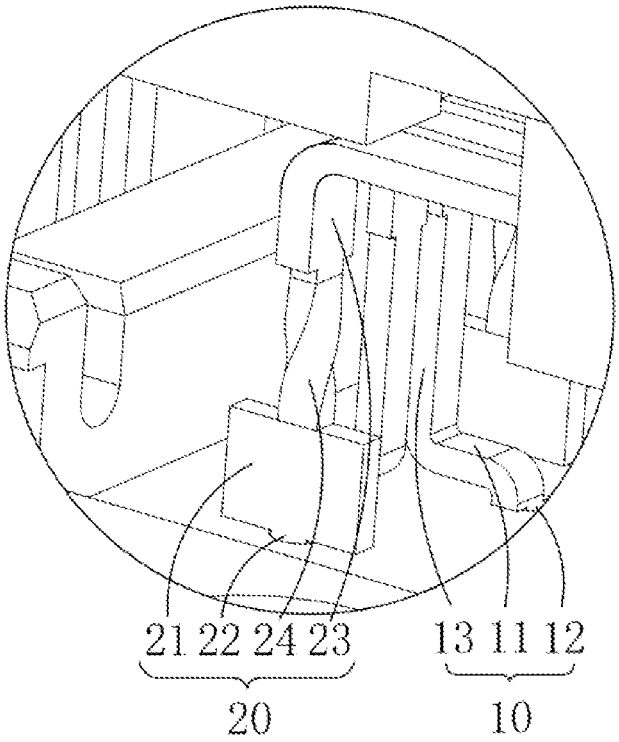
FIG. 9 is another perspective view of an electrical connecting assembly of an embodiment of the present disclosure.

FIG. 9 is another perspective view of an electrical connecting assembly of an embodiment of the present disclosure. As shown in the figure, the width of the ground terminal body 23 is equal to the width of the signal terminal body 13, and the width of the shielding part 21 of the ground terminal is wider than the width of the ground terminal body 23. Similarly, the connecting part 24 connecting the shielding part 21 and the ground terminal body 23 can be twisted 90 degrees to allow the width of the shielding part 21 to electromagnetically shield the bending part 11 of the signal terminal 10.

In another embodiment, it is also possible to directly use the bending of the signal terminal body as a bent part, which can be twisted 90 degrees to be inserted into the signal terminal plugging hole of the circuit board. After being simulated, the integrated crosstalk noise (ICN) of this configuration can also be reduced to the value of 1.9, which also complies with the regulation.

In summary, the present disclosure proposed an electrical connecting assembly. By providing a shielding part at the part of the ground terminal close to the circuit board, and by allowing the width of the shielding part in the direction orthogonal to the baseline to be greater than or equal to the length of the bent part of the signal terminal, the shielding part can at least shield the bent part of the signal terminal to solve the problem of crosstalking noise between signal terminal pairs. Since the ground terminal is provided with a wide shielding part only in the direction orthogonal to the baseline to electromagnetically shield, it would not additionally occupy the circuit board and would not affect the configuration of other electronic components on the circuit board.

It is to be understood that the term "comprises", "comprising", or any other variants thereof, is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connecting assembly, comprising:

an electrical connector comprising a plurality pairs of signal terminals and a plurality of ground terminals, one ground terminal being disposed between two pairs of adjacent signal terminals, each of the signal terminals comprising a bent part and a signal terminal plugging part, the bent part being adjacent to the signal terminal plugging part, each of the ground terminals comprising a shielding part and a ground terminal plugging part, the shielding part being adjacent to the ground terminal plugging part; the shielding part corresponding to the bent part; and a circuit board comprising a plurality pairs of signal terminal plugging holes and a plurality of signal ground terminal plugging holes, the plurality of ground terminal plugging holes being arranged along a baseline; one ground terminal plugging hole being disposed between the two pairs of signal terminal plugging holes, each pair of the signal terminal plugging holes being respectively disposed on two sides of the baseline, the bent parts of the plurality of the signal terminals alternately extending to two sides of the baseline, the signal terminal plugging parts being respectively inserted into the signal terminal plugging holes and being electrically connected to the circuit board, the ground terminal plugging part of each of the ground terminals being correspondingly inserted into the ground terminal plugging hole and being electrically connected to the circuit board;

wherein the width of the shielding part in a direction orthogonal to the baseline is greater than or equal to the length of the bent part of each of the signal terminals extending toward two sides of the baseline.

2. The electrical connecting assembly according to claim 1, wherein each of the signal terminals further comprises a signal terminal body; the bent part is adjacent to the signal terminal body and the signal terminal plugging part and is disposed between the signal terminal body and the signal terminal plugging part; each of the ground terminals further comprises a ground terminal body; the shielding part is adjacent to the ground terminal body and the ground terminal plugging part and is between the ground terminal body and the ground terminal plugging part; the signal terminal bodies of the plurality of signal terminals and the ground terminal bodies of the plurality of ground terminals are arranged along the baseline.

3. The electrical connecting assembly according to claim 2, wherein the width of the ground terminal body in the extending direction of the baseline is wider than the width of the signal terminal body in the extending direction of the baseline.

4. The electrical connecting assembly according to claim 3, wherein the width of the shielding part of the ground terminal in a direction orthogonal to the baseline is equal to the width of the ground terminal body of the ground terminal in the extending direction of the baseline.

5. The electrical connecting assembly according to claim 4, wherein the ground terminal further comprises a connecting part connecting with the ground terminal body and the shielding part; two ends of the connecting part are respectively connected to the midpoint of one end of the ground terminal body and the midpoint of one end of the shielding part; the connecting part has a twisted-shape.

6. The electrical connecting assembly according to claim 1, wherein the width of the shielding part of the ground terminal in a direction perpendicular to the circuit board is wider than the width of the bent part of the signal terminal in a direction perpendicular to the circuit board.

7. The electrical connecting assembly according to claim 1, wherein the baseline passes through the midpoint of the shielding part.

8. The electrical connecting assembly according to claim 2, wherein the bent part of each of the signal terminals is closer than the signal terminal body to the circuit board.

9. The electrical connecting assembly according to claim 2, wherein the shielding part of each of the ground terminals is closer than the ground terminal body to the circuit board.

10. The electrical connecting assembly according to claim 1, wherein the signal terminal plugging part of the signal terminal and the ground terminal plugging part of the ground terminal comprise an elastic press-fitting component; the press-fitting component comprises arc-shaped bumps on its two sides and a hole disposed between the two arc-shaped bumps; the arc-shaped bump abuts against the hole wall of the signal terminal plugging hole and the ground terminal plugging hole.

* * * * *